US009206645B2

(12) United States Patent
Hallundbæk

(10) Patent No.: US 9,206,645 B2
(45) Date of Patent: Dec. 8, 2015

(54) NAVIGATION SYSTEM

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 402 days.

(21) Appl. No.: 13/885,027

(22) PCT Filed: Nov. 14, 2011

(86) PCT No.: PCT/EP2011/070007

§ 371 (c)(1),
(2), (4) Date: May 13, 2013

(87) PCT Pub. No.: WO2012/065934

PCT Pub. Date: May 24, 2012

(65) Prior Publication Data

US 2013/0228375 A1 Sep. 5, 2013

(30) Foreign Application Priority Data

Nov. 15, 2010 (EP) ..... 10191172

(51) Int. Cl.

| | |
|---|---|
| ***E21B 7/04*** | (2006.01) |
| ***E21B 17/02*** | (2006.01) |
| ***E21B 47/01*** | (2012.01) |
| ***E21B 47/022*** | (2012.01) |
| ***E21B 7/06*** | (2006.01) |

(52) U.S. Cl.

CPC . *E21B 7/04* (2013.01); *E21B 7/068* (2013.01); *E21B 17/02* (2013.01); *E21B 47/01* (2013.01); *E21B 47/022* (2013.01)

(58) Field of Classification Search

CPC ..... E21B 7/04; E21B 7/068; E21B 47/01; E21B 17/02; E21B 17/022

See application file for complete search history.

(56) References Cited

U.S. PATENT DOCUMENTS

| | | | | |
|---|---|---|---|---|
| 3,722,605 | A | 3/1973 | Isham | |
| 4,700,142 | A * | 10/1987 | Kuckes | 340/853.5 |
| 4,845,434 | A * | 7/1989 | Kuckes et al. | 324/346 |
| 4,933,640 | A * | 6/1990 | Kuckes | 324/339 |

(Continued)

FOREIGN PATENT DOCUMENTS

| | | |
|---|---|---|
| RU | 2 235 844 C1 | 9/2004 |
| WO | WO 2009/126430 | 10/2009 |

(Continued)

OTHER PUBLICATIONS

International Search Report for PCT/EP2011/070007 mailed Apr. 18, 2012.

(Continued)

*Primary Examiner* — David Andrews
(74) *Attorney, Agent, or Firm* — Nixon & Vanderhye P.C.

(57) ABSTRACT

The present invention relates to a navigation system for navigating a drill head out of or in collision with a casing in a first borehole. The system comprises a drill head drilling a second borehole; a drill string made of several tubulars mounted into one tubular string by means of a connection means, the drill head being mounted onto one end of the drill string; and a plurality of logging units arranged with one logging unit in or in relation to each connection means. Each logging unit comprises a data transmitter and a data receiver for sending and receiving data between the logging units; and a detector, at least one logging unit comprising an emitter. Furthermore, the invention relates to a navigation method using the navigation system.

15 Claims, 2 Drawing Sheets

(56) References Cited

U.S. PATENT DOCUMENTS

| | | | | |
|---|---|---|---|---|
| 5,678,643 | A * | 10/1997 | Robbins et al. | 175/45 |
| 6,321,456 | B1 * | 11/2001 | McElhinnney | 33/313 |
| 8,800,685 | B2 * | 8/2014 | Coman et al. | 175/50 |
| 2009/0289808 | A1 | 11/2009 | Prammer | |
| 2010/0155138 | A1 | 6/2010 | Kuckes | |
| 2011/0100712 | A1 | 5/2011 | Poedjono | |
| 2011/0298462 | A1 | 12/2011 | Clark et al. | |

FOREIGN PATENT DOCUMENTS

| | | |
|---|---|---|
| WO | WO 2009/143409 | 11/2009 |
| WO | WO 2010/059621 | 5/2010 |
| WO | WO 2011/163602 | 12/2011 |

OTHER PUBLICATIONS

International Preliminary Report on Patentability mailed Oct. 29, 2012.

* cited by examiner

NAVIGATION SYSTEM

This application is the U.S. national phase of International Application No. PCT/EP2011/070007 filed 14 Nov. 2011 which designated the U.S. and claims priority to EP 10191172.5 filed 15 Nov. 2010, the entire contents of each of which are hereby incorporated by reference.

FIELD OF THE INVENTION

The present invention relates to a navigation system for navigating a drill head out of or in collision with a casing in a first borehole. The system comprises a drill head drilling a second borehole; a drill string made of several tubulars mounted into one tubular string by means of a connection means, the drill head being mounted onto one end of the drill string; and a plurality of logging units. Furthermore, the invention relates to a navigation method using the navigation system.

BACKGROUND ART

One way of dealing with a well leaking oil is to drill a side track or lateral through which the oil can be diverted to block the top of the leaking well, thereby stopping the leakage. Thus, drilling a side track or lateral from the surface for colliding with the side of the leaking casing at a certain depth requires guidance of the drilling tool during the drilling process.

In addition, drilling a side track from an existing well in an oil field of several wells all having several side tracks also requires that the drill head can be controlled to prevent collision with other side tracks of the same or other wells.

Thus, there is a need for a navigation system for navigating the drill head into collision with a leaking casing or preventing collision with another side track or well.

SUMMARY OF THE INVENTION

It is an object of the present invention to wholly or partly overcome the above disadvantages and drawbacks of the prior art. More specifically, it is an object to provide an improved navigation system capable of detecting other wells or side tracks.

The above objects, together with numerous other objects, advantages, and features, which will become evident from the below description, are accomplished by a solution in accordance with the present invention by a navigation system for navigating a drill head out of or into collision with a casing in a first borehole, comprising:

- a drill head drilling a second borehole,
- a drill string made of several tubulars mounted into one tubular string by means of a connection means, the drill head being mounted onto one end of the drill string,
- a plurality of logging units arranged with one logging unit in or in relation to each connection means,
- each logging unit comprising:
  - a data transmitter and a data receiver for sending and receiving data between the logging units, and
  - a detector,
- at least one logging unit comprising an emitter,
- wherein the emitter of one logging unit emits a signal which is reflected by the casing and detected by the detector of at least two logging units so that a position and/or an extension direction of the casing can be found by means of trigonometry.

In an embodiment, a plurality of logging units may be arranged in one connection means and may be spaced apart along a circumference of the connection means.

By having a logging unit in each tubular connection means connecting two tubulars into a tubular string, the emitter of one logging unit can transmit a signal which is reflected in the existing casing, and when the reflected signal is detected by the detector in two logging units, the position of the existing casing can be calculated. Thus, the flow inside the tubular string is unhindered as the logging unit is arranged in the connection means and not on the inside, and thus all power in the fluid is provided to the drill head. In known ranging tools, a logging unit is arranged inside the tubular string, hindering the free flow of fluid.

In one embodiment, the navigation system may further comprise a communication pack arranged in one of the connection means, dividing the drill string into a top part and a bottom part, the drill head being mounted to the bottom part of the drill string.

Hereby, the logging units arranged in the bottom part communicate to the adjacent logging unit and so forth until the logging unit nearest the communication pack communicates with the communication pack, and then the communication pack collects all data and calculates the position of the casing in relation to the drill head and sends only this set of data to the surface, e.g. to a communication unit in the well head or a the drill rig or vessel. Having a communication pack, only one set of data needs to be sent up and the drilling direction is subsequently adjusted. If all units were to send each their logged data to surface, it would take more time before data reach the operator, and thus any required adjustments of the drilling head would be delayed as compared to the present invention.

Also, the casing may have a length from a well head to a shoe, and the communication pack may be arranged in a first half of the length of the casing from the well head, preferably in a first third of the length of the casing, and more preferably in a first fourth of the length of the casing from the well head.

The communication pack may comprise a data receiver for collecting data representing the detected reflected signal from the logging units.

Furthermore, the communication pack may comprise a transmitter for sending control signals to the drill head.

Moreover, the communication pack may comprise a processor for processing the data received from the logging units.

In addition, the communication pack may calculate a vector representing the position of the drill head in relation to the casing.

Additionally, the communication pack may comprise a communication unit for communicating one set of data up through the top part of the drill string.

Also, the communication pack may comprise a communication unit for communicating one set of data up to the top part of the drill string or to a well head.

The communication unit may communicate the set of data by means of mud pulsing.

Said communication unit may communicate the set of data by means of an antenna.

In an embodiment of the invention, the emitter may be an acoustic source or a magnetic field source.

In addition, the logging units may transmit and/or receive data wirelessly by means of acoustics, electromagnetics, Wi-Fi, ZigBee, wireless LAN, DECT, GSM, UWB, UMTS, Bluetooth, sonic or radio frequency.

Further, the connection means may be a casing collar which in this invention is a tubular collar or a joint, or it may comprise a thread.

Moreover, the logging unit may be arranged in the connection means.

Also, the data receiver may be the detector, or the data transmitter may be the emitter.

In another embodiment, the navigation system may further comprise a tool having a driving unit, such as a downhole tractor, for collecting data from the communication pack and/or the logging units.

Furthermore, the driving unit may comprise wheels.

Said driving unit may comprise projectable and retractable arms having one end rotatably fastened with a body of the driving unit and a wheel rotatably fastened to another end of the arm.

Moreover, the navigation system may comprise a control mechanism for controlling the drill head based on the data received from the logging units.

In yet another embodiment of the invention, the navigation system may further comprise a second emitter, wherein the second emitter may be arranged in the casing or in a second casing.

The present invention furthermore relates to a navigation method using the navigation system as described above, the navigation method comprising the steps of:

drilling the borehole in one drilling direction, emitting a signal by means of the emitter of the logging unit, detecting the signal when it has been reflected by the casing, transmitting the signal as data to an adjacent sensor, receiving the data representing the reflected signals from the logging units, calculating the position and direction of the casing, controlling the drill head in relation to the calculated position of the casing, wherein the steps of calculating are performed while drilling the borehole.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
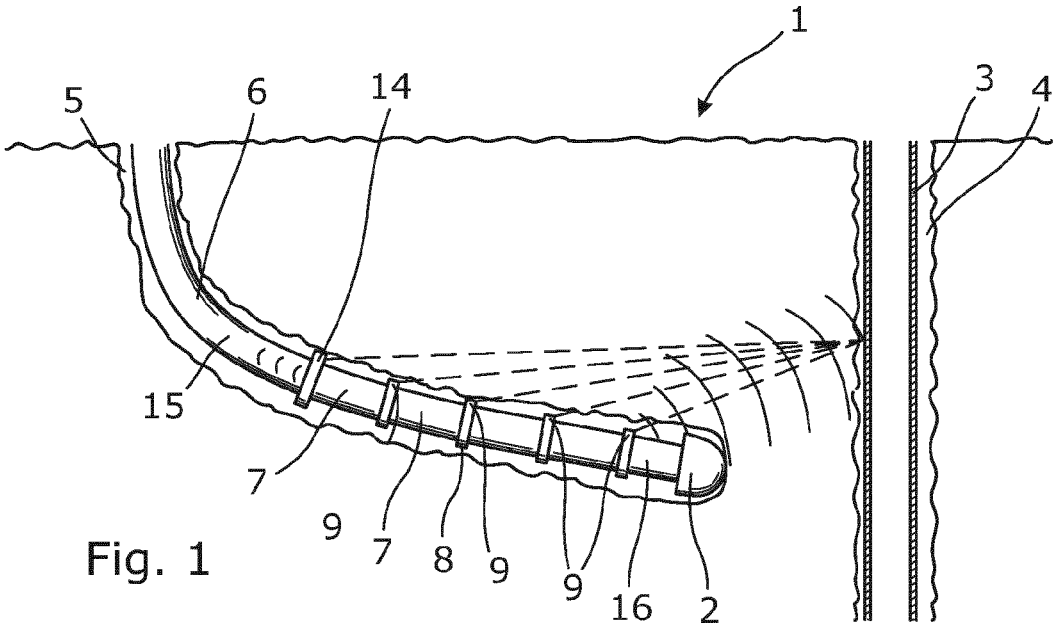
FIG. 1 shows a navigation system navigating a drill head in relation to an existing casing.

The present invention relates to a navigation system 1 for deliberately drilling into a casing 3 to relieve the pressure in, or avoid collision with, the casing. FIG. 1 shows a navigation system 1 comprising a drill head 2 connected to a drill string 6 or drill pipe for drilling a borehole in the formation. The drill pipe is made up of a plurality of pipes connected via connection means 8, such as casing collars, drill pipe collars or joints, and pressurised fluid is supplied through the drill pipe to the drill head 2.

In the connection means 8 of the drill pipe, a logging unit 9 is arranged for conducting measurements while drilling in order to guide the drill head 2 into collision or avoid collision with the casing 3. The logging units 9 are thus arranged at a mutual distance corresponding to the standard length of the pipes joined to form the drill pipe. At least one logging unit 9 has an emitter 12 for emitting a signal which is reflected by the casing 3 in the first borehole 4. Each logging unit 9 comprises a detector 13 for detecting the reflected signal, and since all the logging units 9 are arranged at a mutual distance and all detect the same signal, the position of the casing 3 can be determined by means of trigonometry.

Each logging unit 9 comprises a data transmitter 10 and a data receiver 11, and when the reflected signal is received in a first logging unit 9, that first logging unit transmits data representing the detected reflected signal to the adjacent second logging unit 9. The second logging unit also detects the reflected signal. However, the second logging unit is displaced with a distance and at an angle from the first logging unit 9, resulting in the reflected signal having traveled longer when being detected by one logging unit than by the other logging unit. Thus, the position and direction of the casing 3 can be determined by means of trigonometry.

As shown in FIG. 1, the navigation system 1 comprises a communication pack 14 which is also arranged in connection with a connection means 8. The communication pack 14 divides the drill string 6 into a top part 15 and a bottom part 16. The communication pack 14 comprises a data receiver 17 and receives data representing the reflected signals transmitted from the logging units 9. The data is collected by the communication pack 14 which comprises a processor 18 for processing the data into one data set representing a vector of the position of the casing 3 in relation to the drill head 2 of the navigation system 1. The communication pack 14 transmits the data set up through or in the drill pipe, or just in beeline to the operator, enabling the operator to determine whether the drill head 2 is drilling the second borehole 5 in the predetermined direction, or whether the drilling direction needs to be adjusted to ensure or avoid collision with the existing casing. The communication pack 14 comprises a transmitter 24 for sending control signals to the drill head 2 if the drilling direction needs to be adjusted. Instructions from the operator are received in the communication pack 14 and transmitted through the logging units 9 to the drill head 2.

The communication pack 14 comprises a communication unit 19 for communicating one set of data up through the top part of the drill string 6. One way of communicating to the operator is by means of mud pulses in the fluid. Since the communication pack 14 processes all the data received from the logging units 9 into one set of data, the amount of data is reduced to such an extent that mud pulsing is acceptable. By mud pulsing is meant utilising pressure pulses which propagate in well fluid. The distance from the communication pack 14 to the top of the borehole may be very long, for which reason other communication ways may be inapplicable. Thus, the possibility of processing data downhole is very useful as it facilitates transmission of more information to the top of the borehole over a shorter period of time.

Instead of using mud pulsing for wireless communication between the communication pack 14 and the well head, acoustic or electromagnetic radiation, such as radio waves, may be used to wirelessly transmit data from the sensors and instructions to the drill head. Intermediate transmitter/receiver devices may be arranged between the communication pack 14 and the well head as intermediate communication stations if data are to be communicated over long distances.

In another embodiment, the instructions from the operator to the drill head 2 are sent directly from the communication pack 14 to the drill head 2, e.g. in the form of mud pulses in the fluid.

Figure 2:
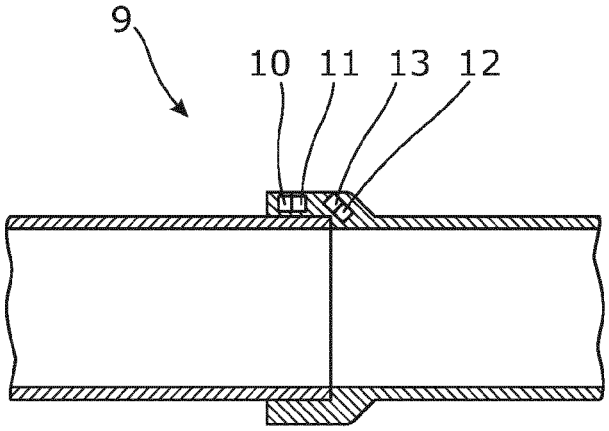
FIG. 2 shows a logging unit arranged in a casing collar.

FIG. 2 shows a logging unit 9 incorporated in a casing collar or drill pipe collar. The logging unit 9 comprises an emitter 12 and a detector 13. The emitter 12 emits a signal out into the formation, and the detector 13 detects the signal when it is reflected by the elements in the formation and an existing casing. The logging unit 9 comprises a data transmitter 10 and a data receiver 11, enabling data representing the reflected signal to be sent to the operator or the communication pack 14 through the adjacent logging units 9.

The data transmitter 10 and the data receiver 11 of the logging unit may be embedded into the collar or arranged in a groove on the inside of the collar, and when two tubulars of a drill pipe are assembled, the tubulars encapsulate the logging unit. When arranged in a groove, the logging unit can be replaced if the logging unit turns out to have been destroyed after mounting.

Figure 3:
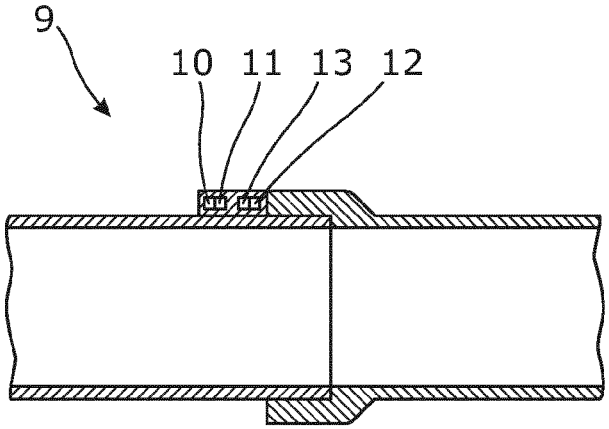
FIG. 3 shows a logging unit arranged in connection with the pipe collar.

The logging unit 9 may also be arranged in connection with a drill pipe collar, as shown in FIG. 3, so that the logging unit 9 is fastened to the collar. In this way, the navigation system 1 can easily be incorporated into an existing drill pipe system.

Figure 4:
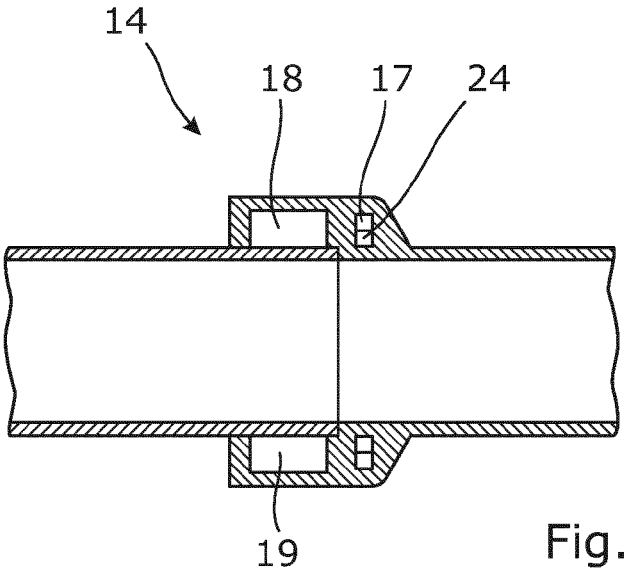
FIG. 4 shows a communication pack arranged in a second collar.

In FIG. 4, the communication pack 14 comprises a data receiver 17 for receiving data from the logging units 9 and a processor 18 for processing the data into one set of data and for transmitting the one set of data to the operator at surface by means of the communication unit 19. The communication unit 19 further comprises a transmitter 24 for sending control signals to the drill head 2, either through the logging units 9 or directly through pulses in the fluid.

Figure 5:
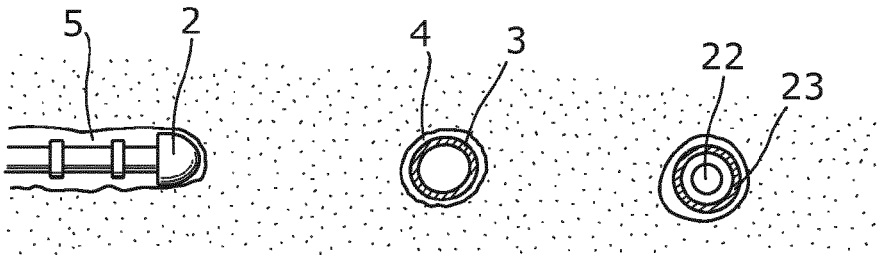
FIG. 5 shows a second emitter arranged in a second casing.

The navigation system 1 may also comprise a second emitter 22 arranged in a second casing 23 in a third borehole, as shown in FIG. 5. This can be useful for guiding the drill head into or out of collision with the first casing in the existing first borehole 4, as signals from the second emitter 22 can also be detected by the detectors of the logging units 9. Thus, the second emitter 22 provides additional measurements, resulting in more precise measurements of the position and direction of the existing casing with which the drill head 2 is to collide or with which the drill head 2 is to avoid collision.

The emitter 12, 22 is an acoustic source or a magnetic field source.

Figure 6:
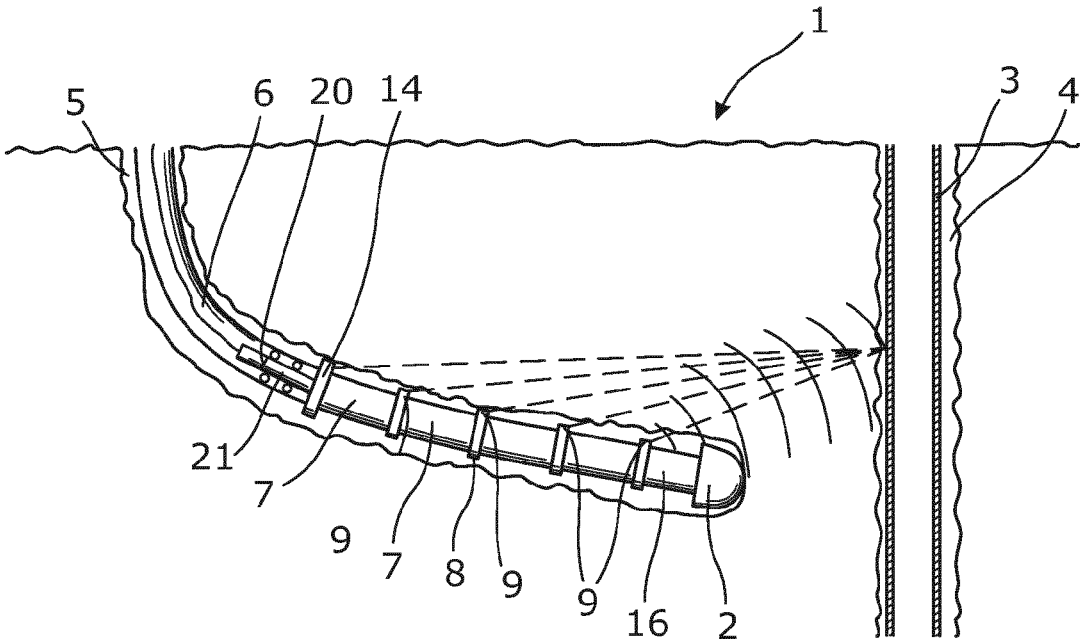
FIG. 6 shows another embodiment of the navigation system.

As shown in FIG. 6, the navigation system 1 comprises a tool 20 submerged into the drill pipe to collect the data from the communication pack 14. In the event that the tool 20 is not submergible all the way into the drill pipe, a driving unit 21, such as a downhole tractor, can be used to push the tool 20 all the way into position in the pipe. A downhole tractor is any kind of driving tool capable of pushing or pulling tools in a well downhole, such as a Well Tractor®. The tool 20 is connected to a wireline or umbilical which can be used to send up data.

All of the calculations described above are performed by the processor 18 arranged in the communication pack 14 immediately when the measurements are available, and are subsequently transmitted to the surface. Thus, the information about the direction and relative position of the drill head 2 in relation to the casing 3 is available to the drilling operator almost instantly, meaning that any necessary actions can be performed without further delay.

Thus, there is no heavy data communication or time-consuming post-processing demanding personnel interpreting the data.

The method using the navigation system 1 comprises the steps of:

drilling the borehole in one drilling direction, emitting a signal by means of the emitter 12 of the logging unit 9, detecting the signal in two logging units when it has been reflected by the casing 3, transmitting the signal as data to an adjacent logging unit closer to a top of the borehole, receiving the data representing the reflected signals from the logging units 9, calculating the position and direction of the casing 3, controlling the drill head 2 in relation to the calculated position of the casing 3, wherein the steps of calculating are performed while drilling the borehole.

In one embodiment, the measuring and calculating steps are performed simultaneously with the drilling of the borehole in the communication pack before the data is transmitted to the top of the borehole or to a tool inserted into the drill pipe.

The measuring and calculating steps are performed simultaneously with the drilling of the borehole, i.e. at least once an hour, preferably at least once every 0.5 hours, and more preferably at least once every 10 minutes. It is also possible to perform the steps more often, such as several times per second.

In order to ensure that the borehole is drilled in the predetermined position, the navigation system 1 may also have a positioning tool.

By fluid or well fluid is meant any kind of fluid which may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string, etc. used downhole in connection with oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A navigation system (1) for navigating a drill head (2) out of or into collision with a casing (3) in a first borehole (4), comprising:

a drill head drilling a second borehole (5), a drill string (6) made of several tubulars (7) mounted into one tubular string by means of a connection means (8), the drill head being mounted onto one end of the drill string, a plurality of logging units (9) arranged with one logging unit in each connection means, each logging unit comprising:

a data transmitter (10) and a data receiver (11) for sending and receiving data between the logging units, and a detector (13), at least one logging unit comprising an emitter (12), wherein the emitter of one logging unit emits a signal which is reflected by the casing and detected by the detector of at least two logging units so that a position and/or an extension direction of the casing can be found by means of trigonometry.

2. A navigation system according to claim 1, further comprising a communication pack (14) arranged in one of the connection means, dividing the drill string into a top part (15) and a bottom part (16), the drill head being mounted to the bottom part of the drill string.

3. A navigation system according to claim 2, wherein the communication pack comprises a data receiver (17) for collecting data representing the detected reflected signal from the logging units.

4. A navigation system according to claim 2, wherein the communication pack comprises a transmitter (24) for sending control signals to the drill head.

5. A navigation system according to claim 2, wherein the communication pack comprises a processor (18) for processing the data received from the logging units.

6. A navigation system according to claim 2, wherein the communication pack calculates a vector representing the position of the drill head in relation to the casing.

7. A navigation system according to claim 2, wherein the communication pack comprises a communication unit (19) for communicating one set of data up through the top part of the drill string.

8. A navigation system according to claim 7, wherein the communication unit communicates the set of data by means of mud pulsing.

9. A navigation system according to claim 1, wherein the emitter is an acoustic source or a magnetic field source.

10. A navigation system according to claim 1, wherein the logging units transmit and/or receive data wirelessly by means of acoustics, electromagnetics, Wi-Fi, ZigBee, wireless LAN, DECT, GSM, UWB, UMTS, Bluetooth, sonic or radio frequency.

11. A navigation system according to claim 1, wherein the connection means is a casing collar or a joint.

12. A navigation system according to claim 1, further comprising a tool (20) having a driving unit (21) for collecting data from the communication pack and/or the logging units.

13. A navigation system according to claim 1, further comprising a control mechanism for controlling the drill head based on the data received from the logging units.

14. A navigation system according to claim 1, further comprising a second emitter (22), wherein the second emitter is arranged in the casing or in a second casing (23).

15. A navigation method using the navigation system according to claim 1, the navigation method comprising the steps of:

drilling the borehole in one drilling direction, emitting a signal by means of the emitter of the logging unit, detecting the signal when the signal has been reflected by the casing, transmitting the signal as data to an adjacent sensor, receiving the data representing the reflected signals from the logging units, calculating the position and direction of the casing, controlling the drill head in relation to the calculated position of the casing, wherein the steps of calculating are performed while drilling the borehole.

* * * * *